US006427995B1

(12) United States Patent
Steinwall

(10) Patent No.: US 6,427,995 B1
(45) Date of Patent: Aug. 6, 2002

(54) QUICK CHANGE JAW SYSTEM

(75) Inventor: Ronald C. Steinwall, Minneapolis, MN (US)

(73) Assignee: Prairie Technical Industries, Inc., Coon Rapids, MN (US)

( * ) Notice: Subject to any disclaimer, the term of this patent is extended or adjusted under 35 U.S.C. 154(b) by 0 days.

(21) Appl. No.: 09/560,266

(22) Filed: Apr. 26, 2000

(Under 37 CFR 1.47)

Related U.S. Application Data

(60) Provisional application No. 60/131,034, filed on Apr. 26, 1999.

(51) Int. Cl.[7] ..... B25B 1/24
(52) U.S. Cl. ..... 269/283
(58) Field of Search ..... 269/257, 285, 269/271, 274, 280, 282, 283, 286

(56) References Cited

U.S. PATENT DOCUMENTS

| | | | | |
|---|---|---|---|---|
| 1,393,083 A | * | 10/1921 | Campbell | 269/282 |
| 4,078,782 A | * | 3/1978 | Carlson | 269/283 |
| 4,191,367 A | * | 3/1980 | Speiser et al. | 269/283 |
| 4,251,066 A | * | 2/1981 | Bowling | 269/283 |
| 4,422,629 A | * | 12/1983 | Carlson | 269/282 |
| 5,024,427 A | * | 6/1991 | Swann | 269/283 |
| 5,197,834 A | * | 3/1993 | Chase et al. | 269/282 |
| 6,022,010 A | | 2/2000 | Bernstein | |

OTHER PUBLICATIONS

Kurt Manufacturing Company, *Kurt Manufacturing Workholding Catalog*, 1996.
Snap Jaw Manufacturing, *Snap Jaws Original Quick–Change Vise Jaws*.
Kurt Manufacturing Company, *Double Lock Precision Machine Vise with 2 Clamping Stations*, 1988.
Kurt Manufacturing Company, *Innerlock Jaw—The Innovative Reversible Quick Change Jaws*.
Hilma Carr Lane Roemheld, *Jaws—Clamping with System*, 1/96.
Kurt Manufacturing Company, *Kurt Manufacturing Industrial Products Catalog*, 1/99.

* cited by examiner

*Primary Examiner*—Robert C. Watson
(74) *Attorney, Agent, or Firm*—Patterson, Thuente, Skaar & Christensen, P.A.

(57) ABSTRACT

A quick-change jaw system for use on a clamping mechanism, the clamping mechanism having a first pair of jaw members, each of the first pair of jaw members having a first longitudinal face, a second longitudinal face, and a jaw body, includes a second pair of jaw members, each of the second pair of jaw members having a jaw body, a first face being machinable for compressively engaging a work piece and an opposed second face, the second face having at least a first protrusion, the protrusion being engageable with a portion of a respective first jaw member. A locking pin member is actuable for lockingly engaging the protrusion with the respective first jaw member. Additionally, a method for repeatably clamping a work piece for effecting desired working operations on the work piece is included.

21 Claims, 6 Drawing Sheets

QUICK CHANGE JAW SYSTEM

RELATED APPLICATION

The present application claims the benefit of U.S. Provisional Application No. 60/131,034 filed Apr. 26, 1999, which is incorporated herein in its entirety by reference.

BACKGROUND OF THE INVENTION

The-present invention relates to a quick-change vise jaw plate attachment system that is releasably secured, tightened, and locatable in each of the x, y, and z dimensions, thereby increasing efficiency and reducing cost.

In industry, there is a need to create easily removable custom shaped clamping jaws to hold an odd shaped work piece, because conventional flat-faced vise jaws may distort the shape of this work piece when tightened in the vise. These custom contoured jaws are frequently referred to as "soft jaws" and the jaw plates they are attached to are referred to as the "hard jaws".

A machining operation must be able to switch between different types of work pieces on the same machine. When switching involves several different irregular shapes, the operator must switch between corresponding soft jaws. Since switchover time is lost production time, it is advantageous to provide for a quick release method of attaching soft jaws. Examples of quick release systems are described in U.S. Pat. Nos. 6,022,010 and 4,898,371.

SUMMARY OF THE INVENTION

The present invention discloses a removable quick-change jaw system for a clamping system and a method for attaching the same, that locates a clamping jaw in the x-axis, y-axis, and z-axis simultaneously. The machinable jaw, with truncated protrusions formed into its body, fits into a second jaw attached to the clamping body, and is secured to together by rotating a locking pin mechanism. The cam lock mechanism is mounted in the second jaw and provides an interference that pulls the machinable jaw into the rigid jaw.

An object of the present invention is to overcome several disadvantages present in the prior art. These advantages are as follows:

1. The present invention provides for securably locating the soft jaw in all three dimensions, x, y, and z. This is desirable because machining may be required to meet tolerances in depth, length, and width in the same operation. The prior art teaches the use of a slot in the soft jaw which slides over a type of engageable lock pull. This action can only locate the jaw in two directions. The location along the slot will not be repeatable within the required tolerance once the jaw is removed and recalled at a later time. Therefore, when tight tolerances are required, a new soft jaw must be mounted and machined. The present invention allows the soft jaws to be stored and recalled for additional production runs even on pieces that require tight tolerances, because the tapered protrusions, when locked to the hard jaw, relocate in all three dimensions.
2. The present invention provides for a self-releasing interface. Those skilled in the art recognize a self-releasing interface to comprise a taper with an included angle greater than 16 degrees. Prior art which teaches the use of a slot fitting over an engageable lock pull often requires an applied force such as a hammer in order to remove the soft jaw. This may damage the soft jaw. In one embodiment, the tapered protrusion of the soft jaw in the present invention has an included angle of 20 degrees. This allows the soft jaw to self-release from the hard jaw.
3. The present invention provides for a completely machinable interface. Soft jaws are utilized in industry by mounting a soft jaw blank in a vise. Then the soft jaw is machined to the required contour while in place. The machinable area is limited in the prior art due to the presence of the slot and a lock. The soft jaw could not be machined into the slot or damage to the interlocking mechanism may occur. The present invention presents no slotting or internal hardware within the soft jaw, thereby providing for greater adaptability to various shapes as well as a greater margin for error.
4. The present invention eliminated the need for removable fastening hardware. Some prior art designs teach the use of various types of fasteners, such as screws, to secure the soft jaw to the hard jaw. Others, such as the '010' patent teach the use of a removable locking pin. Both of these result in loose hardware which can be easily lost. The present invention teaches a permanently installed locking pin within the hard jaw. This locking pin can secures the soft jaw protrusion by rotating the pin by 180 degrees. A return rotation of 180 degrees releases the soft jaw.
5. The present invention allows the hard jaw to function as a flat faced hard jaw when the soft jaw is uninstalled. Frequently, an operator is required to place a piece in the vise for additional machining wherein flat sides of the piece must be gripped by the vise jaws. The operator must remove the soft jaws in order to avoid damaging the contours. When the soft jaws are removed in the prior art, the remaining hard jaw presents locking hub protrusions that prevent conventional use. The present invention does not present these protrusions. It presents substantially a flat surface, thereby allowing conventional use.
6. Finally, the present invention reduces cost by eliminating parts, saving set up time, and extending the useful life of a soft jaw. The present invention consists of a soft jaw, a hard jaw, and cam lock mechanism. Prior art teaches the use of a soft jaw, hard jaw, wedge lock and wedge locking actuators. By eliminating the wedge lock, the present invention reduces costs by reducing the number of components. The present invention saves setup costs and extends the useful life of the soft jaw because the soft jaws can be stored and recalled repeatedly, whereas soft jaws taught by the prior art must often be re-machined from "new" soft jaws when tight tolerances are required.

The present invention is a quick-change jaw system for use on a clamping mechanism, the clamping mechanism having a first pair of jaw members, each of the first pair of jaw members having a first longitudinal face, a second longitudinal face, and a jaw body. The present invention includes a second pair of jaw members, each of the second pair of jaw members having a jaw body, a first face being machinable for compressively engaging a work piece and an opposed second face, the second face having at least a first protrusion, the protrusion being engageable with a portion of a respective first jaw member. A locking pin member is actuable for lockingly engaging the protrusion with the respective first jaw member. Additionally, the present invention is a method for repeatably clamping a work piece for effecting desired working operations on the work piece.

DETAILED DESCRIPTION OF THE DRAWINGS

Figure 1:
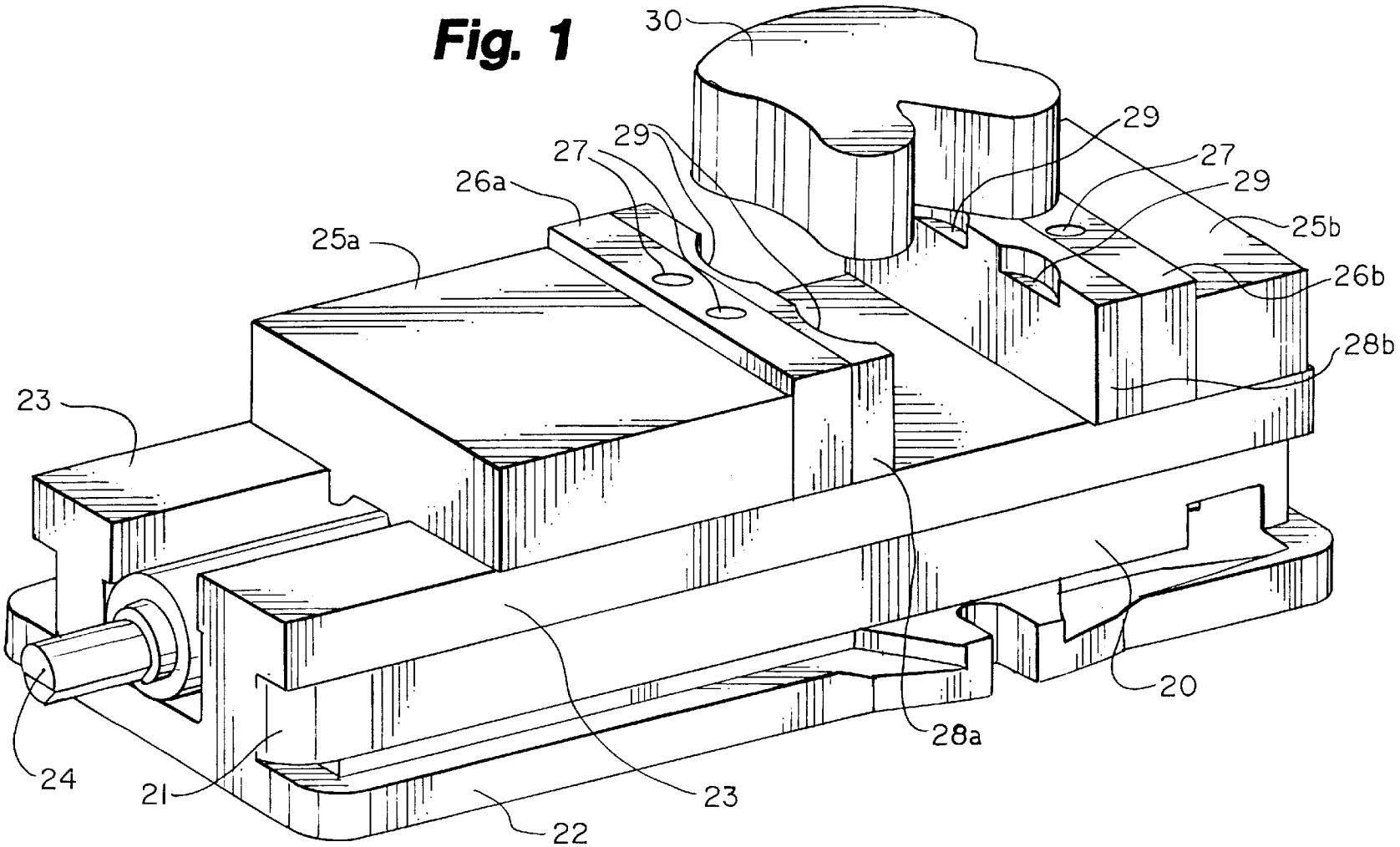
FIG. 1 is a perspective view of a vise embodying the principles of the present invention.
Figure 2:
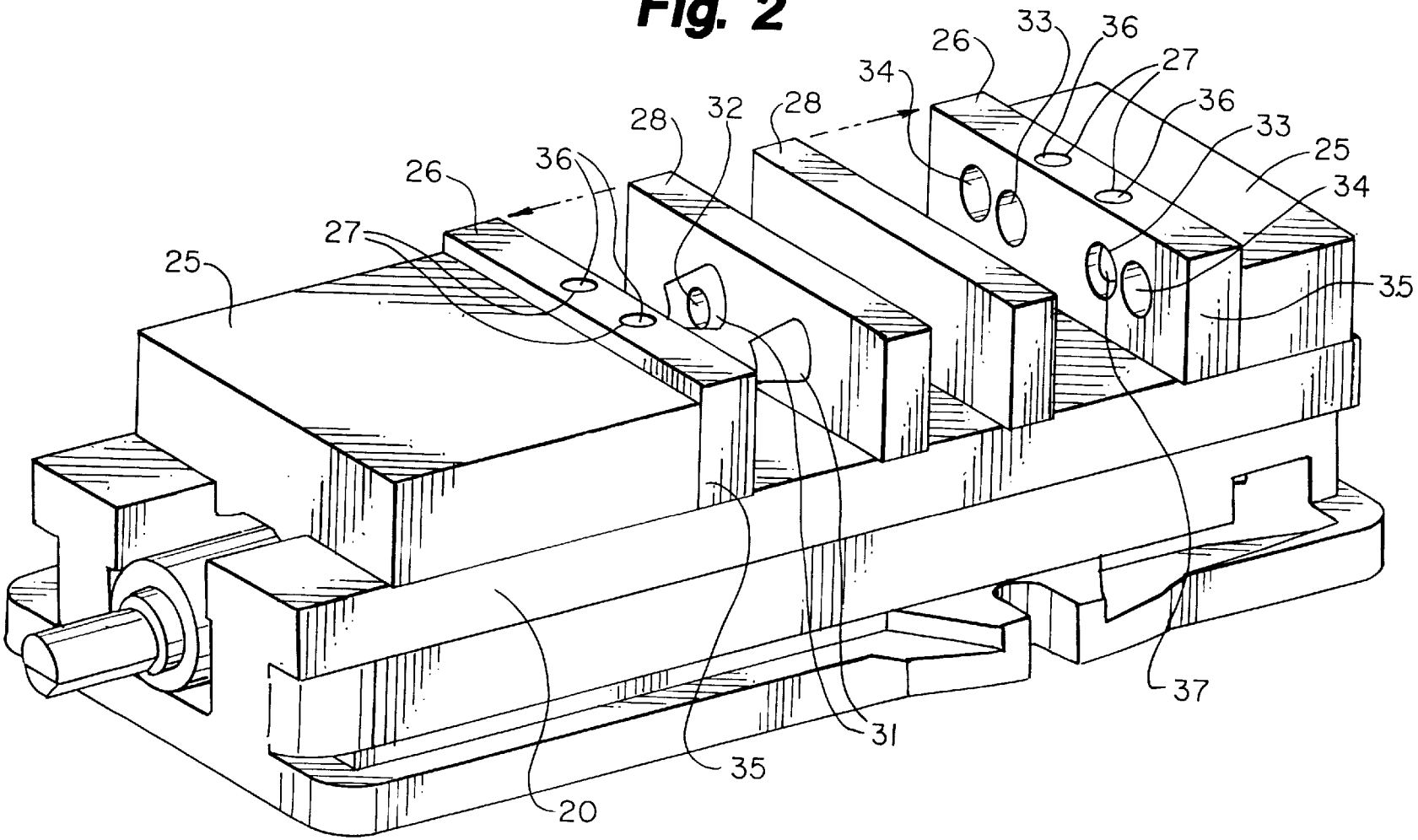
FIG. 2 is an assembly view of the vise from FIG. 1, showing attachment of the second pair of jaws.

A quick change jaw system, incorporating the soft jaws 28 of the present invention, is depicted generally at 20 in FIGS. 1 and 2. Quick change jaw system 20 has a vise body 21 with a base plate 22, side walls 23, vice screw 24, and movable jaws 25*a*, 25*b*. The vice screw 24 can be rotated about its central axis, thereby moving the movable jaws 25*a*, 25*b* longitudinally with respect to the vise body 21. Suitable types of vises 20 are available from Kurt Manufacturing Company, Inc., however those skilled in the art will recognize; other clamping mechanisms applicable to the present invention.

Figure 3:
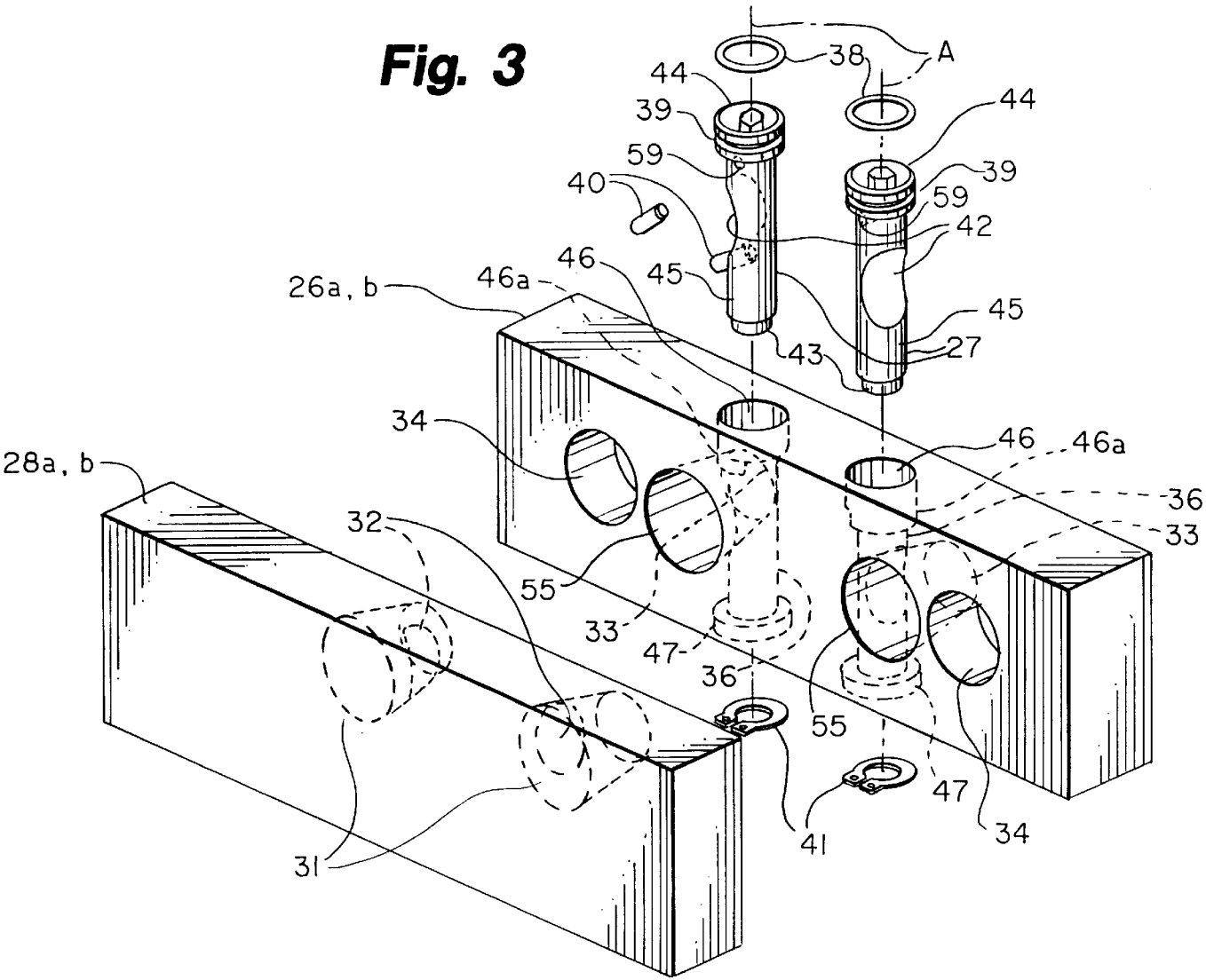
FIG. 3 is an assembly diagram of the vise of quick-change clamping system from FIG. 1.
Figure 4:
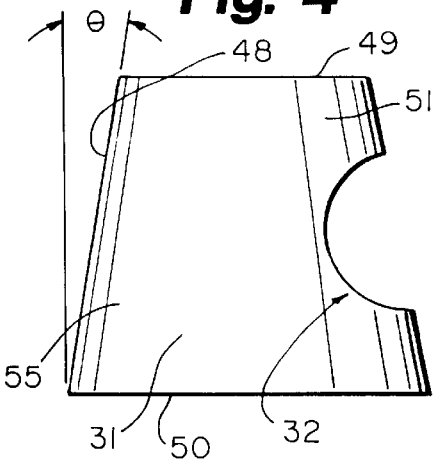
FIG. 4 is a sectional view of a truncated cone shaped protrusion on the second pair of jaws of FIG. 2.
Figure 5:
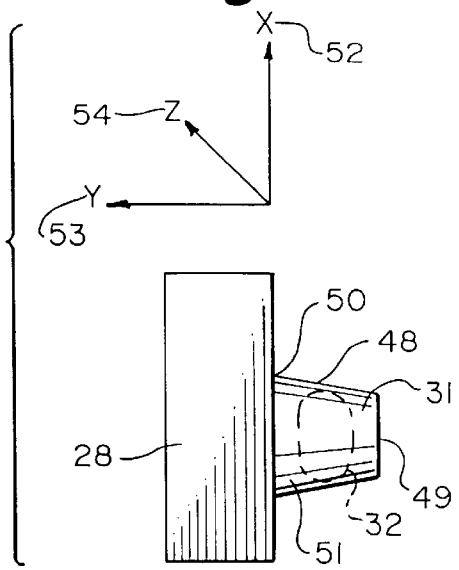
FIG. 5 is a sectional side view of the second pair of jaws f FIG. 2.
Figure 6:
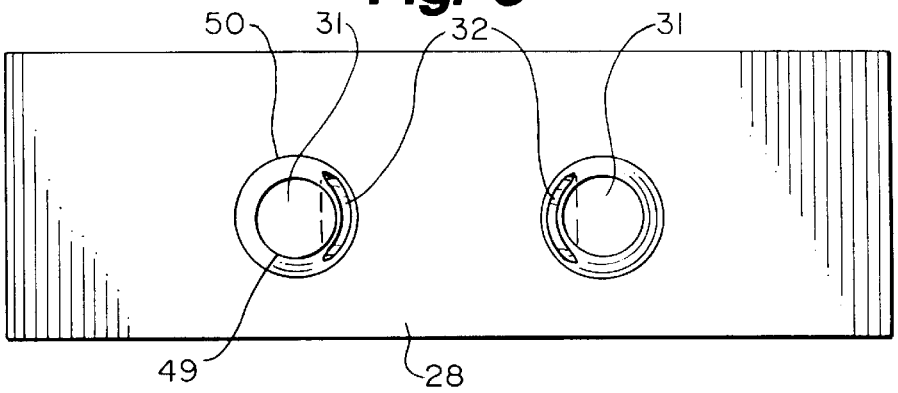
FIG. 6 is a sectional rear view of the second pair of jaws of FIG. 2.
Figure 7:
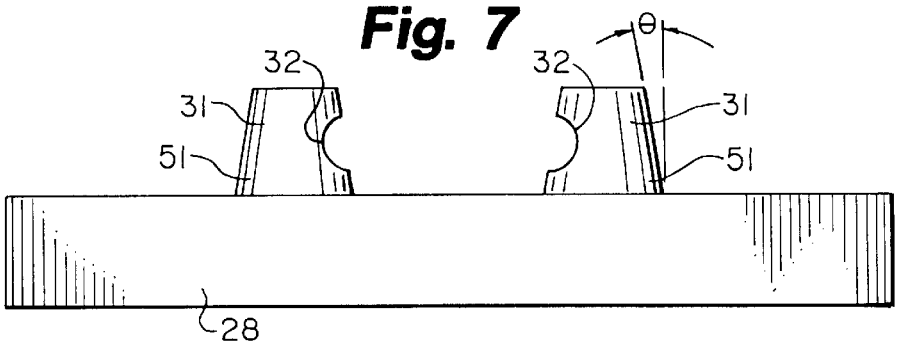
FIG. 7 is a sectional top view of the second pair of jaws of FIG. 2.

As shown in FIG. 1, the first set of jaws ("hard jaws") 26*a*, 26*b* are affixed to the movable jaws 25*a*, 25*b*, respectively, by a means described below. The second set of jaws ("soft jaws") 28*a*, 28*b* are fitted into the respective hard jaws 26*a*, 26*b* and secured in place by rotating the locking pins 27 one-half turn about the longitudinal axis A, as depicted in FIG. 3. An illustrative irregular work piece 30 (see FIG. 1)is shown to indicate how the contours 29 of the soft jaws 25*a*, 25*b* are machined to rigidly grip the work piece 30 without potentially damaging said piece 30.

Fastening bores 34 are provided for in the hard jaw body 35 so that the hard jaws 26*a*, 26*b* may be attached to the movable jaws 25*a*, 25*b* of the vice 20. In a preferred embodiment, the fastening bores 34 are machined such that they permit the hard jaws 26*a*, 26*b* to be attached by a method provided by the vise manufacturer. Often, this method consists of threaded alien screws which are received by threaded bores in the movable jaws 25*a*, 25*b*.

Vertical bores 36 are defined in the hard jaw body 35 which are sized to accept the locking pins 27. The vertical bores 36 intersect the receiving holes 33, thereby exposing the longitudinal surface 37 of the locking pin 27. The exposed longitudinal surface 37 of locking pin 27 is then disposed to engage cam notch 32 when the soft jaw 28*a*, 28*b* is placed against the respective hard jaw 26*a*, 26*b*.

As shown in FIGS. 2, 3 and 5–7, the soft jaws 28 have protrusions 31 which resemble truncated cones. The protrusions 31 taper, reducing the circumference the further the circumference is taken from the face of the soft jaw 28. There are preferably two protrusions 31 per soft jaw 28, but more or fewer protrusions 31 would work as well. Each protrusion has a cam notch 32 machined in it. The cam notches 32 are defined by a section of a cylinder intersecting the protrusion 31. Where a pair of protrusions 31 are used, the cam notches 32 are defined facing each other. The soft jaws 28 are attached to the hard jaws 26 by inserting the protrusions 31 into receiving holes 33 bored into the hard jaw body 35.

Figure 8:
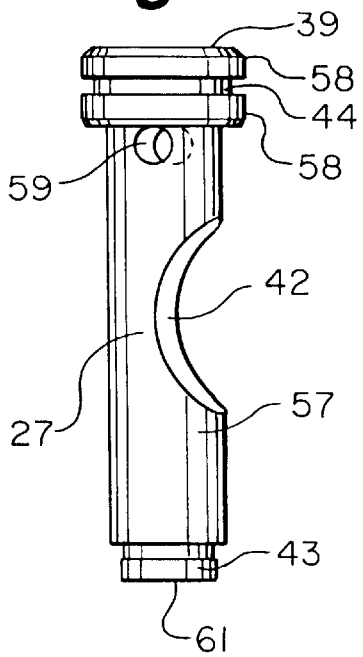
FIG. 8 is a sectional side view of the cam lock pin of vis from FIG. 1.
Figure 12:
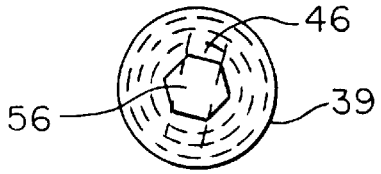
FIG. 12 is a sectional top view of the cam lock pin of FIG. 8.

FIG. 3 is an exploded assembly drawing of a preferred embodiment of the soft jaws 28*a*, 28*b* and a corresponding hard jaws 26*a*, 26*b*. The soft jaw 28 has protrusions 31 with cam notches 32 intersecting the protrusion 31. The hard jaw 26 has vertical bores 36, receiving holes 33, and fastening bores 34. The vertical bores intersect the receiving holes 33. The receiving holes 33 taper inward to a reduced diameter at the inner margin. The taper of the receiving holes 33 closedly matches the taper of the protrusions 31. As depicted in FIGS. 3, 8, and 12 the cam lock pins 27 include a bottom end groove 43 machined to allow retention within the hard jaw body 35 with a clipping fastener 41. The longitudinal surface 45 of the cam lock pin 27 has a cam notch 42 which corresponds to the cam notch 32 of the soft jaw protrusions 31. The top end 39 of the cam lock pins 27 have a groove 44 which allows a sealing ring 38 to be mounted therein. The purpose of the sealing ring 38 is to prevent working fluids and debris from entering the cam notch 42. In the preferred embodiment, a limiting pin 40 is disposed within a small transverse bore 59 defined in the cam lock pin 27. The length of the limiting pin 40 is greater than the length of the transverse bore 59 such that when the limiting pin 40 is disposed within the transverse bore 59, the ends of the limiting pin 40 extend beyond the outer margin of the cam lock pin 27. The purpose of the limiting pin 40 is to restrict the rotational potential of the cam lock pin 27 to only 180 degrees, thereby creating a fully locked and fully unlocked position of the lock pin 27. The vertical bores 36 have sufficiently sized bore portions 46 and 47 to receive the limiting pin 40 and clipping fastener 41 respectively. A slightly greater than semicircular notch 46*a* is defined at the lower margin of the bore portion 46 to capture the protruding ends of the limiting pin 40.

FIGS. 4, 5, 6, and 7 are cutaway sectional views of a preferred embodiment of the protrusion 31 on the soft jaw 28. The protrusion 31 has a longitudinal surface 51, a cam notch 32, a taper 48, a smaller radial surface 49, and a larger radial surface 50. The cam notch 32 is machined into the longitudinal surface 51 of the protrusion 31. The notch enables the soft jaw 28 to be "locked" into place in the receiving hole 33 by a cam lock pin 27.

The taper 48 in cooperation with the taper 55 of the receiving hole 33 enables the soft jaw 31 to be repeatedly located within the receiving holes 33 in the x-axis 52, y-axis 53, and z-axis 54 simultaneously. Interference fit between the tapered surface 48 of the protrusion 31 and the reverse tapered surface 55 of the receiving hole 33 of the hard jaw body 35 provides this highly repeatable three-dimensional locating ability.

The taper 48 allows the protrusion 31 to comprise a self-releasing taper lock with the receiving holes 33. Persons skilled in the art of machining or arts related thereto, recognize that a self-releasing taper is a taper with an included edge 55 greater than sixteen degrees. In a preferred embodiment, the protrusion 31 (and the corresponding receiving hole 33) has an included angle 55 of twenty degrees.

The soft jaw 28 should be made of a soft enough material to allow it to be readily machined. One such material is T6 aluminum. The soft jaw 28 blanks are themselves machined to a high tolerance prior to machining of the contour 29. It is important to maintain a high tolerance because the protrusions 31 are interference fit into the hard jaws 26. By maintaining a tight tolerance on the protrusions 31 and the receiving holes 33, the soft jaw 28 is able to relocate repeatedly within +/−0.0005 inches. In order to preserve this high level of relocatibility, the operator must not remove the hard jaws 26 from the movable jaws 25. Since the hard jaws 26 are mounted to the movable jaws 25 by a means provided by the manufacturer, the hard jaws 26 are not relocatable within the desired tolerance, and their additional displacement uncertainty will be transferred to the soft jaws 28 even though the soft jaws 28 may be repeatedly recoupled to the hard jaw 26 within the above tolerances. The hard jaws 26 of the present invention allow the same functionality as conventional hard jaws, thereby making it unnecessary to remove the quick-change system entirely when conventional operation is desired.

FIGS. 8 and 12 are sectional views of the cam lock pin 27. The locking pin 27 has a circular shaped top end 39 with a hex groove 56. The hex groove 56 allows the operator to use a standard hex wrench to rotate the cam lock pin 27. The top end also has two retaining rings 58 machined in the pin that are of slightly larger diameter than the pin body 57, creating a groove 44 therebetween. The groove 44 is approximately the same width as a sealing ring 38 that fits into the groove 44. An appropriate type of sealing ring is a simple rubber o-ring. The sealing ring functions to keep lubricating fluid and debris from the machining operation out of the vertical bores 36 in the hard jaw 26.

The small lateral bore 59 in the pin body 57 is sized to accept the limiting pin 40. The purpose of the limiting pin 40 is to limit rotation of the cam lock pin to 180 degrees. The advantage of using a limiting pin 40 is to ensure that the operator does not rotate the cam lock pin 27 more than 180 degrees because the soft jaw 28 would no longer be held tightly in place. The limiting pin 40 cooperates with a stepped bore 46*a* in the upper portion 46 of the vertical bore 36. The stepped bore 46*a* restricts the limiting pin's 40 rotational travel. In a preferred embodiment, two locking pins 27 are used and each is a mirror of each other, thereby promoting relocatibility.

The bottom end 61 of the cam lock pin 27 has a slotted ring 43 shaped to accept a clipping fastener 41. An e-clip or equivalent type fastener 41 is desirable since they are cheap, easily removable, and do not require specialized tools. The cam lock pin 27, with limiting pin 40 installed, is inserted into the vertical bore 36 of the hard jaw 26. Then the clipping fastener 41 is interlocked with the bottom end 61 of the cam lock pin 27 to secure the cam lock pin 27 in place. The cam lock pin 27, once secured in the hard jaw 26, does not have to be removed to actuate the quick-change mechanism.

Figure 9:
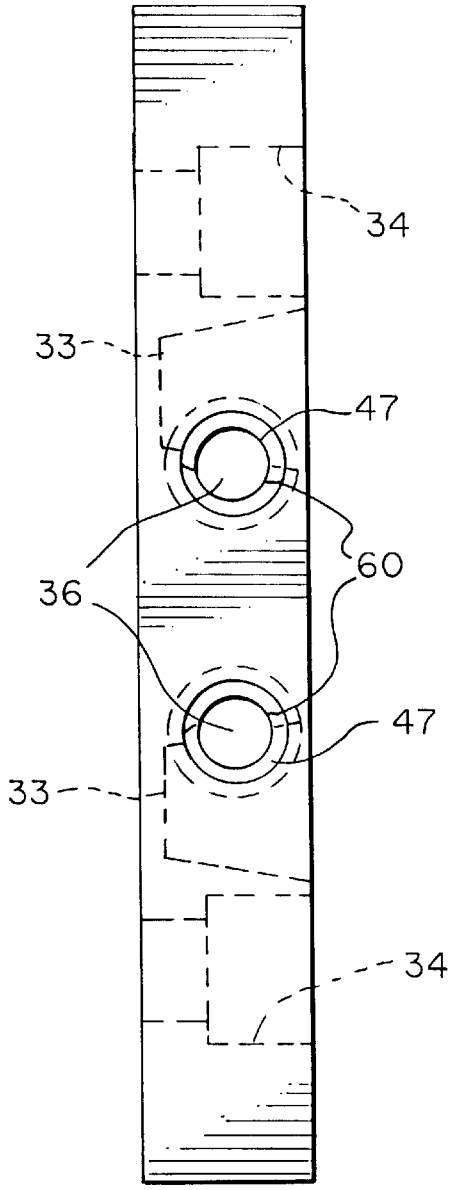
FIG. 9 is a sectional top view of the first pair of jaws of FIG. 2.
Figure 10:
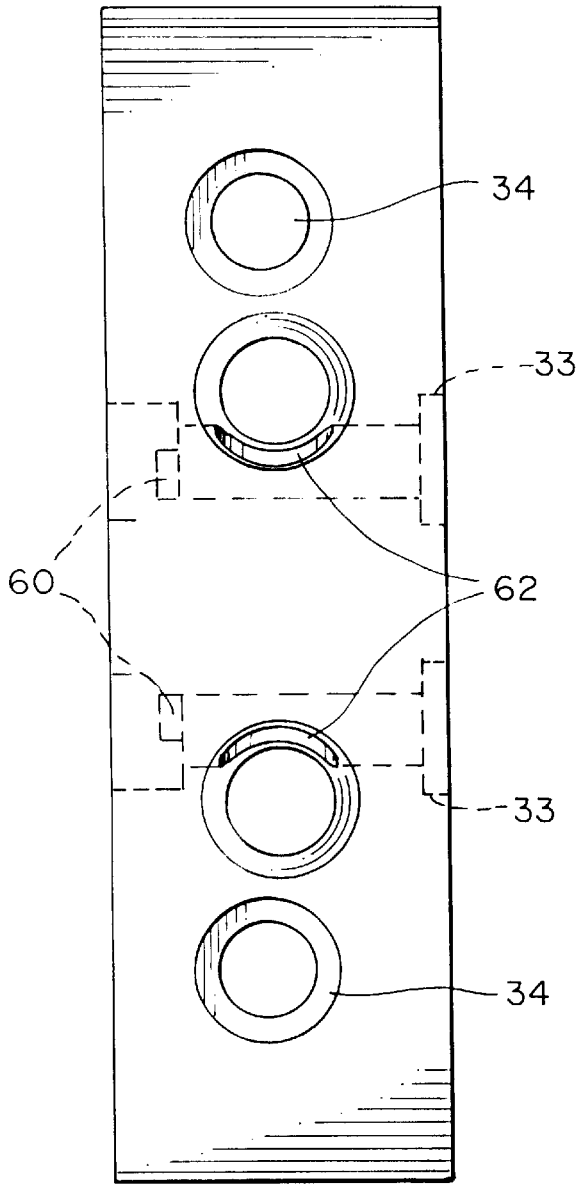
FIG. 10 is a sectional rear view of the first pair of jaws of FIG. 2.
Figure 11:
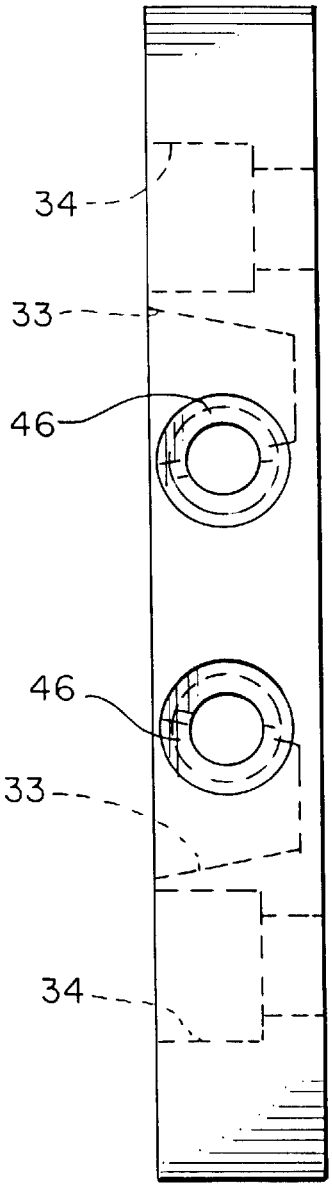
FIG. 11 is a sectional bottom view of the first pair of jaws of FIG. 2.

FIGS. 9, 10, and 11 are sectional views of the bottom, side, and top of the hard jaw 26 respectively. The stepped bore 46*a* is provided on the bottom surface of the hard jaw 28. The relative location of the vertical bores 36, the receiving holes 33, and the fastening bores 34 are shown in FIGS. 9, 10, and 11. The cam lock apertures 62 are shown in the receiving holes 33 which allow the cam lock pins 27 to engage the cam notches 32 when the operator rotates the hex groove 56 with a hex wrench 180 degrees until the limiting pin 40 stops rotation.

In Operation

The first step in mounting the quick-change jaw system 20 is to assemble the cam lock pins 27. The operator first slides the limiting pins 40 into the small transverse bores 59 in the cam lock pins 27. A portion of the limiting pins 40 protrudes from both sides of the surface margin of the cam pins 27. Next, the sealing rings 38 are slid over the retaining rings 58 until the sealing rings 38 come to rest within the groove 44. Insert the assembled locking pins 27 into their respective vertical bores 36 in the hard jaws 26*a*, 26*b*. The clipping fastener 41 is then slid over the bottom end 61 of the cam lock pin 27 to secure the pin 27 in place. Finally, a check should be made to ensure that the cam lock pins 27 freely rotate within bores 36 of the respective hard jaw 26*a*, 26*b*.

The next step is to mount the hard jaw 26*a*, 26*b* on a respective movable jaw 25*a*, 25*b*. The quick-change jaw system is preferably designed to utilize the vice manufacturer's provided means of attaching jaws. Typically the vice manufacturer provides threaded horizontal bores in the movable jaws 25*a*, 25*b* allowing common allen screws to be used. Therefore, using allen screws, insert said screws into each of the fastening bores 34 provided in the hard jaw 26*a*, 26*b*. Align the allen screws with their respective threaded bore in the movable jaws 25*a*, 25*b*. Use a corresponding allen wrench to tighten the allen screws until the hard jaw 26*a*, 26*b* is tightly secured against the respective movable jaw 25*a*, 25*b*. In order to maintain tolerances of the present application, the hard jaws 26*a*, 26*b* must not be moved relative to the jaws 25*a*, 25*b*.

The final step in assembling the quick change jaw system is to securably mount the soft jaws 28*a*, 28*b* to their respective hard jaws 26*a*, 26*b*. First, rotate the cam lock pins 27 one-half turn until their cam notches 42 face the interior of the receiving holes 33. Then, insert the soft jaw 28*a*, 28*b* protrusions 31 into their respective receiving holes 33. Finally, use a hex wrench to rotate the cam lock pins 27, utilizing the pin's hex groove 56, until the limiting pins 40 restrict rotational movement. The cam notch 42 of the cam lock pin 27 engages the respective cam notch 32 on the protrusions 31 of the soft jaws 28*a*, 28*b*, thereby releasably securing the soft jaws 28*a*, 28*b* when the cam lock pins 27 are rotated one-half turn by the operator.

The soft jaws 28*a*, 28*b* should now be machined or milled by the operator to the desired contour 29 corresponding to the particular work piece to be operated on. An illustrative example of a custom contoured work piece 30 is shown in FIG. 1 along with corresponding contours 29 on the soft jaws 28*a*, 28*b*. Once the soft jaws 28*a*, 28*b* are machined to the desired contour, they are adapted to compressively hold a custom contoured work piece. It is important to note that the contour 29 can be machined through the entire body of the soft jaw 28 without interfering with the means for coupling the soft jaw 28 to the hard jaw 26.

When the operator has finished a run of a particular custom contoured work piece, the soft jaws 28*a*, 28*b* may be released from the hard jaws 26*a*, 26*b* and stored so that the machine vise can be used for other machining operations. The soft jaws 28*a*, 28*b* are released by using a hex wrench inserted in the hex groove 56 of the locking pin 27 and reversibly rotating the cam locking pins 27 one-half turn until the limiting pins 27 restrict further rotational travel. The soft jaws 28*a*, 28*b* will then self-release from their respective hard jaws 26*a*, 26*b*. The soft jaws 28*a*, 28*b* may be stored until later recalled to perform additional runs or operations with corresponding custom contoured work pieces.

It is important to remember that the hard jaws 26*a*, 26*b* should not be removed from the movable jaws 25*a*, 25*b* after they have been initially mounted in order to ensure being able to maintain the tolerances that the present invention is capable of. If the hard jaws 26*a*, 26*b* are removed, they will not be able to be relocated within the required tight tolerance for machining purposes without recalibration. The quick-change jaw system 20 of the preferred embodiment is capable of being relocated within 0.0005 inches, provided that the hard jaws 26*a*, 26*b* are not removed between initial machining of the soft jaws 28*a*, 28*b* and subsequent recall of the soft jaws 28*a*, 28*b*. The hard jaws 26*a*, 26*b*, however, do not need to be removed from the machine vise in order to use the vice in a conventional manner. When the soft jaws 28*a*, 28*b* are removed, the hard jaws 26*a*, 26*b* present a flat hard surface for gripping a work piece in a conventional manner.

When the operator desires to recall a particular set of soft jaws 28*a*, 28*b*, they may be easily and quickly relocated. The operator simply inserts the protrusions 31 into the respective receiving holes 33 in the hard jaws 26*a*, 26*b* and rotates the cam lock pins 27 one-half turn until the soft jaws 28*a*, 28*b* are securably relocated, thereby providing the desired tolerance in three orthogonally oriented dimensions upon relocation. It is not necessary to machine fresh soft jaws 28*a*, 28*b* to perform operations on additional runs of previously used custom contoured work pieces.

Although the present invention has been described with reference to the preferred embodiments, workers skilled in the art will recognize changes may be made in from and detail without departing from the spirit and scope of the invention.

What is claimed is:

1. A quick-change jaw system for use on a clamping mechanism, the clamping mechanism having a first pair of jaw members, each of the first pair of jaw members having a first longitudinal face, a second longitudinal face, and a jaw body, the quick-change jaw system comprising:

a second pair of jaw members, each of the second pair of jaw members having a jaw body, a first face being machinable for compressively engaging a work piece and an opposed second face, the second face having at least a first protrusion, the protrusion comprising a truncated cone having a base circumference, a longitudinal surface, and an end margin, the protrusion being engageable with a portion of a respective first jaw member; and a locking pin member being actuable for lockingly engaging the protrusion with the respective first jaw member, wherein the protrusion and locking pin member of each of the second pair of jaw members effect a repeatable locking engagement with the respective first jaw member in three orthogonally disposed dimensions.

2. The quick-change jaw system of claim 1, wherein a circumference of the end margin of the truncated cone protrusion has a smaller diameter than the base circumference, the longitudinal surface being tapered from the base circumference to the end margin.

3. The quick-change jaw system of claim 1, wherein the first jaw body includes a plurality of apertures in said jaw body to securably receive an attachment means adjoined to the clamping body.

4. The quick-change jaw system of claim 1, wherein the at least a first protrusion of each of the second jaw members jaw body is receivable in a corresponding receiving hole defined in the respective first pair of jaws member.

5. The quick-change jaw mechanism of claim 4, wherein the locking pin members are disposable in a locking pin bore defined in the respective first jaw body, the locking pin bore intersecting the corresponding receiving hole defined in the respective first pair of jaws member.

6. The second pair of jaws of claim 1, wherein the protrusion includes a notch defined therein for engaging the locking pin member.

7. The quick-change jaw system of claim 1, wherein said plurality of locking pin members comprise cam lock pins the cam lock pins effecting a camming locking engagement between each of the second pair of jaw members and the respective first jaw member.

8. The quick change jaw system of claim 7, wherein the cam lock pins further comprise:

an elongated cylinder having a first end, a second end, and a longitudinal generally cylindrical surface disposed about a longitudinal axis, the longitudinal generally cylindrical surface having a notch defined therein and a bore through the longitudinal surface being substantially transverse to the longitudinal axis; and rotational limiting means insertable in the transverse bore for limiting the rotation of the cam lock pin about the longitudinal axis.

9. A quick-change jaw system for use in a clamping mechanism, the quick-change jaw system comprising:

a pair of hard jaws being operably couplable to the clamping mechanism, each of the pair of hard jaws having a jaw body;

a pair of soft jaws, each of the pair of soft jaws having a jaw body, the jaw body being readily machineable to define a clamping surface for compressively engaging a work piece, means for removably operably coupling a one of the soft jaws to a one of the hard jaws, the means for removably operably coupling including one or more generally conical shaped protrusions; and a locking pin member operably couplable to both the one of the soft jaws and the one of the hard jaws for releasably affixing the one of the soft jaws to the one of the hard jaws thereby repeatably locating the one of the soft jaws relative to the one of the hard jaws in three orthogonally oriented dimensions.

10. The quick-change jaw system of claim 9 effecting a self-releasing locking interface between the one of the soft jaws and the one of the hard jaws.

11. The quick-change jaw system of claim 9 wherein the jaw body clamping surface is extendable through substantially the entire jaw body free of interference with the means for removably operably coupling the one of the soft jaws to the one of the hard jaws.

12. The quick-change jaw system of claim 9, wherein the protrusion and locking pin member of each of the pair of soft jaw members are operably couplable to effect a repeatable locking engagement with the respective hard jaw member in three orthogonally disposed dimensions.

13. The quick-change jaw system of claim 12, wherein said plurality of locking pin members comprise cam lock pins the cam lock pins effecting a camming locking engagement between each of the pair of soft jaw members and the respective hard jaw member.

14. The quick change jaw system of claim 13, wherein the cam lock pins further comprise an elongated cylinder having a first end, a second end, and presenting a generally cylindrical surface disposed about a longitudinal axis, the generally cylindrical surface having a notch defined therein and a bore defined through the cylinder, the bore being substantially transverse to the longitudinal axis; and rotational limiting means insertable in the transverse bore for limiting the rotation of the cam lock pin about the longitudinal axis.

15. The quick-change jaw system of claim 12, wherein the protrusions on the soft jaw body comprise a truncated cone having a base circumference, a longitudinal surface, and an end margin.

16. The quick-change jaw system of claim 15, wherein a circumference of the end margin of the truncated cone protrusion has a smaller diameter than the base circumference, the longitudinal surface being tapered from the base circumference to the end margin.

17. The quick-change jaw system of claim 13, wherein the hard jaw body includes a plurality of apertures defined in said jaw body to fixedly receive an attachment means for fixedly coupling to the clamping body.

18. The quick-change jaw system of claim 15, wherein the protrusion of each of the soft jaw members jaw body is receivable in a corresponding receiving hole defined in the respective hard jaw member.

19. The quick-change jaw mechanism of claim 18 wherein the receiving hole defines a truncated conical shape corresponding to the respective protrusion.

20. The quick-change jaw mechanism of claim 18, wherein the locking pin members are disposable in a locking pin bore defined in the respective hard jaw body, the locking pin bore intersecting the corresponding receiving hole defined in the respective hard jaws member.

21. The quick-change jaw mechanism of claim 12, wherein the protrusion includes a notch defined therein for engaging the locking pin member.

* * * * *

UNITED STATES PATENT AND TRADEMARK OFFICE

CERTIFICATE OF CORRECTION

PATENT NO. : 6,427,995 B1
DATED : August 6, 2002
INVENTOR(S) : Steinwall

It is certified that error appears in the above-identified patent and that said Letters Patent is hereby corrected as shown below:

Column 1,
Line 10, delete "The-present" and insert -- The present --.
Line 36, delete "to together" and insert -- together --.

Column 2,
Line 17, "'010'" should not be in bold.
Line 21, delete "can".

Column 3,
Line 6, delete "f" and insert -- of --.
Line 11, delete "vis" and insert -- vise --.
Lines 33-34, delete "recognize;" and insert -- recognize --.
Line 42, after "(see FIG. 1)" insert a space.

Column 4,
Line 10, delete "jaws" and insert -- jaw --.

Column 7,
Line 24, delete "from" and insert -- form --.

Column 8,
Line 2, after "lock pins" insert -- , --.
Line 50, after the first occurrence of "pin", insert -- , --.

Column 10,
Line 8, delete "jaws" and insert -- jaw --.

Signed and Sealed this

Eighteenth Day of March, 2003

JAMES E. ROGAN
*Director of the United States Patent and Trademark Office*